US007013580B2

(12) United States Patent
Morlacchi

(10) Patent No.: US 7,013,580 B2
(45) Date of Patent: Mar. 21, 2006

(54) WATERPROOF FOOTWEAR AND PROCESS FOR ITS MANUFACTURE

(75) Inventor: Luca Morlacchi, Legnano (IT)

(73) Assignee: NEXTEC s.r.l., Busto Arsizio VA (IT)

( * ) Notice: Subject to any disclaimer, the term of this patent is extended or adjusted under 35 U.S.C. 154(b) by 14 days.

(21) Appl. No.: 10/948,917

(22) Filed: Sep. 24, 2004

(65) Prior Publication Data

US 2005/0055843 A1 Mar. 17, 2005

Related U.S. Application Data

(63) Continuation of application No. PCT/IT03/00161, filed on Mar. 18, 2003.

(30) Foreign Application Priority Data

Mar. 26, 2002 (IT) ..... MI2002A0626

(51) Int. Cl.
*A43B 23/07* (2006.01)

(52) U.S. Cl. ..... 36/12; 36/55; 36/10; 12/142 T; 12/142 RS

(58) Field of Classification Search ..... 36/12, 36/14, 10, 55; 12/142 T, 142 RS
See application file for complete search history.

(56) References Cited

U.S. PATENT DOCUMENTS

| | | | | |
|---|---|---|---|---|
| 4,899,465 A | | 2/1990 | Bleimhofer et al. | |
| 5,285,546 A | | 2/1994 | Haimerl | |
| 5,505,011 A | | 4/1996 | Bleimhofer | |
| 5,689,903 A | * | 11/1997 | Aumann | 36/77 R |
| 5,711,093 A | * | 1/1998 | Aumann | 36/77 R |
| 6,088,935 A | * | 7/2000 | Pavelescu et al. | 36/14 |
| 6,474,001 B1 | * | 11/2002 | Chen | 36/55 |
| 6,474,002 B1 | * | 11/2002 | Chen | 36/55 |
| 6,604,302 B1 | * | 8/2003 | Polegato Moretti | 36/55 |
| 2001/0049889 A1 | * | 12/2001 | Chen | 36/55 |
| 2002/0040537 A1 | * | 4/2002 | Polegato Moretti | 36/14 |

FOREIGN PATENT DOCUMENTS

| | | |
|---|---|---|
| DE | 38 40 263 A1 | 5/1990 |
| DE | 40 04 674 A1 | 8/1991 |
| DE | 198 57 899 C1 | 10/2000 |
| EP | 1 197 158 A1 | 4/2002 |
| WO | WO 00/22948 A1 | 4/2000 |

* cited by examiner

*Primary Examiner*—M. D. Patterson
(74) *Attorney, Agent, or Firm*—Akin Gump Strauss Hauer & Feld, LLP

(57) ABSTRACT

An article of waterproof footwear is provided which contains a sole (1) joined to an insole (2) and to a welt (3) which encloses the lower edge of an upper (4), the inner surface of which is lined by a preferably semi-permeable membrane (6). The lower edge of the membrane is glued to a waterproof tape (7) joined to the insole (2). The welt (3) is preferably made in a single piece of plastic or rubber material with the sole (1). A process of manufacturing the waterproof footwear is also provided.

13 Claims, 1 Drawing Sheet

WATERPROOF FOOTWEAR AND PROCESS FOR ITS MANUFACTURE

CROSS-REFERENCE TO RELATED APPLICATIONS

This application is a continuation of International Application No. PCT/IT03/00161, filed Mar. 18, 2003, the disclosure of which is incorporated herein by reference.

BACKGROUND OF THE INVENTION

The present invention relates to waterproof footwear, and in particular to a shoe or a boot with a waterproof upper and a sole made of a plastic or rubber material. The present invention also relates to a process for manufacturing said footwear.

Known articles of waterproof footwear comprise a sole, which is injection-molded together with an insole sewn with the lower edges of an upper, and a protective lining comprising one or more fabric layers coupled with one or more semi-permeable membranes, i.e., membranes which can be crossed by steam, not by water. In these known articles of footwear, the upper, especially if made of leather, may absorb water. This water thus penetrates the upper through the seam with the insole, thereby going around the protective lining.

For avoiding this drawback, U.S. Pat. No. 4,899,465 discloses a waterproof footwear, the upper of which is joined to the insole by means of a perforated portion or a net tape. During the sole molding, a portion of plastic or rubber material separates the upper from the insole, thereby preventing the water from passing through them. However, also in this known footwear, the water may cross the upper, so as to be absorbed by the outer fabric of the lining and pass, also if in a reduced way, inside the footwear through the seam of the insole. Furthermore, it is relatively complex to carry out the holes in the upper and the net tape is quite wide and rigid and thus hampers the sole bending.

For avoiding these further drawbacks, U.S. Pat. No. 5,505,011 discloses a waterproof footwear similar to the previous one, with the exception that the lower edge of the upper is not perforated or provided with nets. Rather, it is directly glued to the protective lining, which is prolonged up to the insole and sewn to it. However, also in this known footwear, very small quantities of water filter through the upper and may stagnate in the interspace between the lining and the upper.

DE 4004674 discloses a waterproof footwear wherein a waterproof tape is glued along the outer lower edge of the upper, so as to allow minimum water penetration through the upper. DE 3840263 discloses a waterproof footwear wherein a sealing tape is sewn along the inner lower edge of the upper and the hot-welded to a membrane. This manufacturing process is relatively difficult to perform due to the relative positions of upper, tape and membrane.

BRIEF SUMMARY OF THE INVENTION

It is therefore an object of the present invention to provide a waterproof footwear which is free from said disadvantages. Said object is achieved with an article of footwear and a process for its manufacture.

According to the present invention, an article of footwear comprises a sole (1) joined to an insole (2) and to a welt (3), wherein the welt (3) encloses a lower edge of an upper (4), an inner surface of the upper (4) is lined with a waterproof or semi-permeable membrane (6), and wherein a waterproof tape (7) is joined to the insole (2) and is glued along the lower inner edge of the upper (4) lined with the membrane (6).

A process for manufacturing an article of footwear comprises the following steps:

- internally lining an upper (4) with a waterproof or semi-permeable membrane (6);
- gluing a waterproof tape (7) to a lower edge of the upper (4) lined with the membrane (6);
- joining the waterproof tape (7) to an insole (2) to join the insole (2) to the upper (4); and
- inserting the insole (2) joined to the upper (4) in a mold, thereby forming a sole (1) under the insole (2) and forming a welt (3) around a lower edge of the upper (4) and around a portion of the waterproof tape (7) between the lower edge of the upper (4) and the insole (2).

BRIEF DESCRIPTION OF THE SEVERAL VIEWS OF THE DRAWINGS

The foregoing summary, as well as the following detailed description of the invention, will be better understood when read in conjunction with the appended drawing. For the purpose of illustrating the invention, there are shown in the drawing embodiments which are presently preferred. It should be understood, however, that the invention is not limited to the precise arrangements and instrumentalities shown.

In the drawing.

DETAILED DESCRIPTION OF THE INVENTION

Figure 1:
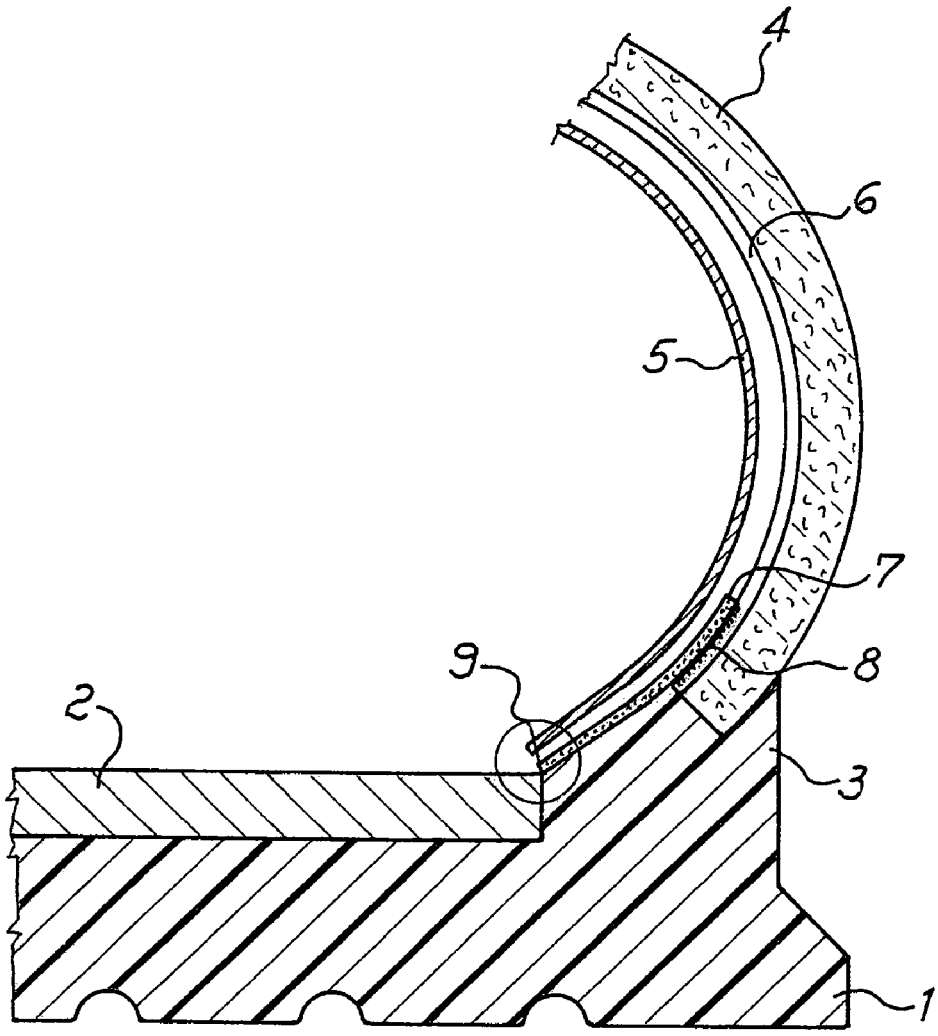
FIG. 1 shows a partial cross-section view of an article of footwear manufactured according to the process of the invention.

As a result of the semi-permeable membrane, which lines the inside of the upper, and to the waterproof tape which joins the upper to the insole, the footwear according to the present invention is perfectly waterproof, not only over the whole surface of the upper, but also along its lower edge.

Furthermore, the footwear according to the present invention does not necessarily require the use of a protective lining. If desired, a protective lining can be sewn to the insole without any risk of water seepage.

According to a particular advantageous aspect of the invention, the semi-permeable membrane is joined to the upper by means of a glue pattern, so that it does not hamper the steam crossing.

The waterproof tape is preferably provided with a layer of thermo-active glue, as those already employed in the textile industry, so that footwear manufacturing according to the process of the present invention becomes faster, simpler and cheaper.

Further advantages and features of the footwear and the process according to the present invention will become clear to those skilled in the art from the following detailed and non-limiting description of an embodiment thereof with reference to the attached drawing.

As shown in FIG. 1, the waterproof footwear according to the present embodiment of the invention comprises in a known way a sole 1 of a plastic or rubber material, which is joined to an insole 2 arranged above sole 1 and to a welt 3. The welt is preferably made in a single piece with sole 1 and encloses the lower edge of an upper 4 and of an inner lining 5, if present.

According to the invention, the inner surface of upper 4 is lined by a waterproof or semi-permeable membrane 6, whose surface turned toward upper 4 is preferably provided with a pattern of glue, in particular thermo-active glue. It may thus be hot-laminated through a process such as that described in PCT application No. WO 00/22948 in the name of applicant. In the present embodiment, membrane 6 is semi-permeable, i.e., suitable for preventing water, not steam, from going through. Membrane 6 preferably comprises a sheet of polyurethane, polytetrafluoroethylene, polyester or other polymeric material which is non-porous, and has a thickness between 5 $\mu$m and 100 $\mu$m, so as to let the steam go through by osmosis. An edge of a waterproof tape 7, the opposite edge of which is in turn joined, in particular sewn, to insole 2, is suitably glued along the inside of the lower edge of upper 4. The portion 8 of the waterproof tape 7 glued onto membrane 6 of upper 4 is 7 to 10 mm wide, while lining 5, if any, can be sewn to insole 2 with the same seam 9 which joins the waterproof tape 7 to insole 2. The waterproof tape 7 is 15 to 20 mm wide and is preferably already provided with a layer of thermo-active glue, so that it can be hot-glued. The glue can also act as waterproofer for a tape which is not waterproof by itself.

In the manufacturing process according to the present invention, upper 4 is internally lined by the semi-permeable membrane 6, after which the waterproof tape 7 is glued to its lower edge and sewn to insole 2 with lining 5, if desired. Finally, insole 2 joined to upper 4 is inserted into a mold in which melted plastic or rubber material is injected. The latter, by solidifying in the mold, forms sole 1 under insole 2 and forms welt 3 around the lower edge of upper 4 and around the portion of waterproof tape 7 between the lower edge of upper 4 and insole 2.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An article of footwear comprising a sole (1) joined to an insole (2) and to a welt (3), wherein the welt (3) encloses a lower edge of an upper (4), an inner surface of the upper (4) is lined with a waterproof or semi-permeable membrane (6), and wherein a waterproof tape (7) is joined to the insole (2) and is glued along the lower inner edge of the upper (4) lined with the membrane (6), so that the lower edge of the upper (4) and menbrane is sealed between the tape (7) and the welt (3).

2. The article of footwear according to claim 1, wherein the welt (3) and the sole (1) together comprise a single piece of plastic or rubber material.

3. The article of footwear according to claim 1, wherein the membrane (6) is semi-permeable.

4. The article of footwear according to claim 3, wherein the membrane (6) comprises a sheet of polymeric, non-porous, material.

5. The article of footwear according to claim 1, wherein the membrane (6) is joined to the upper (4) by a glue pattern comprising a thermo-active glue.

6. The article of footwear according to claim 1, wherein the waterproof tape (7) is sewn to the insole (2) with a seam (9).

7. The article of footwear according to claim 6, wherein a lining (5) is sewn to the insole (2) with the seam (9).

8. The article of footwear according to claim 1, wherein the waterproof tape (7) has a width of 15 to 20 mm, and wherein a portion (8) of the waterproof tape glued to the upper (4) has a width of 7 to 10 mm.

9. The article of footwear according to claim 1, wherein the waterproof tape (7) is glued to the upper (4) with a layer of thermo-active glue.

10. A process for manufacturing an article of footwear, comprising the following steps:

internally lining an upper (4) with a waterproof or semi-permeable membrane (6);

gluing a waterproof tape (7) to a lower edge of the upper (4) lined with the membrane (6);

joining the waterproof tape (7) to an insole (2) to join the insole (2) to the upper (4); and inserting the insole (2) joined to the upper (4) in a mold, thereby forming a sole (1) under the insole (2) and forming a welt (3) around a lower edge of the upper (4) and around a portion of the waterproof tape (7) between the lower edge of the upper (4) and the insole (2), so that the lower edge of the upper (4) and menbrane is sealed between the tape (7) and the welt (3).

11. The process according to claim 10, further comprising sewing a lining (5) to the insole (2) together with the waterproof tape (7).

12. The process according to claim 10, wherein the sole (1) and the welt (3) are formed by injecting melted plastic or rubber material into the mold and solidifying the material.

13. The article of footwear according to claim 4, wherein the polymeric, non-porous material is selected from the group consisting of polyurethane, polytetrafluoroethylene, and polyester.

* * * * *